United States Patent [19]

Tezuka

[11] 4,247,564

[45] Jan. 27, 1981

[54] PACKAGE FOR LAVER-WRAPPED RICE-BALL

[76] Inventor: Akitomi Tezuka, 15-10, Kinuta 3-Chome, Setagaya-ku, Tokyo, Japan

[21] Appl. No.: 18,860

[22] Filed: Mar. 9, 1979

[51] Int. Cl.[3] ..... B65D 75/02; B65B 25/08; B65B 11/00

[52] U.S. Cl. ..... 426/115; 53/429; 53/430; 53/461; 206/492; 206/548; 229/56; 229/87 F; 426/90; 426/120; 426/123; 426/410

[58] Field of Search ..... 426/500–502, 426/420, 106, 119, 120, 112, 115, 132, 389, 124, 123, 410, 90, 297, 274, 275, 128, 113, 394; 53/461, 430, 211, 465, 117, 118, 466, 214, 429; 206/492, 548; 229/87 A, 56, 87 F, 87 R, DIG. 13

[56] References Cited

U.S. PATENT DOCUMENTS

| | | | |
|---|---|---|---|
| 834,474 | 10/1906 | Jackson | 426/124 |
| 1,587,280 | 6/1926 | Burke | 229/87 F |
| 1,959,485 | 5/1934 | Marshall | 426/130 X |
| 2,055,333 | 9/1936 | Burke | 426/132 |
| 2,726,156 | 12/1955 | Amstrong | 426/501 |
| 2,745,753 | 5/1956 | Ayres | 426/132 |
| 2,830,910 | 4/1958 | Swanson | 426/119 |
| 2,893,876 | 7/1959 | Murphy | 426/106 |
| 3,031,309 | 4/1962 | Bogner | 426/113 |
| 3,113,874 | 12/1963 | Baush et al. | 426/412 |
| 3,225,920 | 12/1965 | Reilly | 229/87 |
| 3,355,303 | 11/1967 | Meyers | 426/128 |
| 3,412,851 | 11/1968 | Coulombe | 229/87 A |
| 3,830,035 | 8/1974 | Hoover | 53/461 |
| 4,094,120 | 6/1978 | Goncalves | 53/429 |
| 4,143,165 | 3/1979 | Daswick | 426/120 |
| 4,145,449 | 3/1979 | Nelham | 426/120 |

FOREIGN PATENT DOCUMENTS

| | | | |
|---|---|---|---|
| 479177 | 12/1951 | Canada | 426/120 |
| 121012 | 8/1971 | Denmark | 229/56 |
| 4134076 | 6/1970 | Japan | 426/410 |
| 761098 | 11/1956 | United Kingdom | 229/87 F |

*Primary Examiner*—Steven L. Weinstein
*Attorney, Agent, or Firm*—McGlew and Tuttle

[57] ABSTRACT

This invention relates to a package for an elongated rice-ball or bread and butter comestible together with a laver in an isolated manner until the comestible is wrapped with the laver. The package includes a long moisture-proof sheet such as vinyl or paraffin-coated paper doubled by folding it at the center thereof. The leading edge of the folded back surface may be again folded back in the opposite direction to form a short tongue. The comestible is placed on the single-layered end portion of the sheet and a laver is interposed between the juxtaposed portions of the sheet. The comestible can be wrapped together with the laver without laver becoming moist and the laver can be removed from between the juxtaposed portions of the sheet and wrapped around the comestible.

3 Claims, 4 Drawing Figures

PACKAGE FOR LAVER-WRAPPED RICE-BALL

BACKGROUND OF THE INVENTION

Field of the Invention

This invention relates to the field of preparation of food products, and particularly to the preparation of a package comprising an elongated comestible, such as a rice-ball or bread and butter, and layer that is to be wrapped directly around the comestible immediately before the latter is eaten. Prior to such wrapping, the laver is separated from the comestible by a waterproof sheet folded to provide juxtaposed portions between which the layer is placed to separate it from the comestible.

For a portable lunch, rice is often made into a ball which is wrapped with dry-laver. This laver-wrapped rice-ball is very popular food in Japan and it is called "Onigiri" or "Sushi". Although the laver is dried at first, it gradually gets moist after it is wrapped around the rice-ball, because it is in direct contact with the rice-ball. After the laver gets moist, its flavor is so deteriorated while losing its intrinsic crisp feeling that it is no longer appetizing.

SUMMARY OF THE INVENTION

The primary object of the present invention is to provide a package for self-hand wrapping a rice-ball or bread and butter comestible together with dry laver in an insulated manner until the comestible is wrapped with the dry laver.

Another object of the present invention is to provide a package of the above type, by which the laver wrapping operation can be accomplished by hand without directly touching the comestible or the laver, thereby improving convenience and sanitation, as well as the enjoyment of eating the food.

A further object of the present invention is to provide a package of the above type from which can be cut off only a portion of the comestible in the packaged condition, according to the amount the consumer would like to eat. The remaining portion can be left preserved in the packaged state.

BRIEF DESCRIPTION OF THE DRAWINGS

In order that the invention may be more readily understood reference is made to the accompanying drawings which illustrate schematically and by way of example two embodiments thereof and in which.

DESCRIPTION OF THE PREFERRED EMBODIMENT

Figure 1:
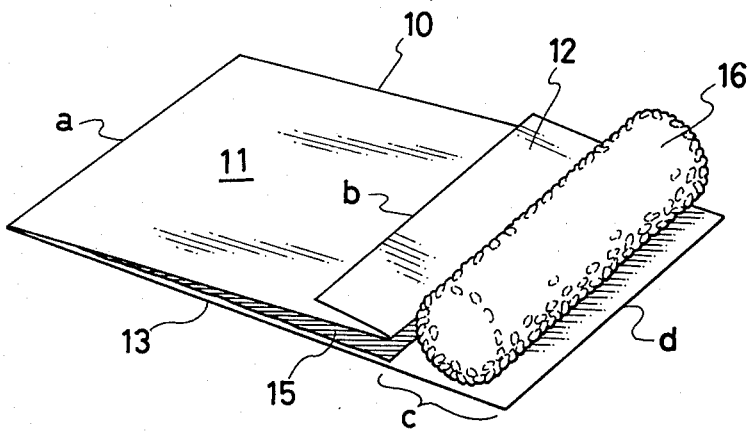
FIG. 1 is a perspective view showing an early stage in preparing a rice-ball in which a laver is interposed between the folded paper and with a rice-ball placed on the paper.

In FIG. 1, a long piece of a moisture-proof material 10 made of material such as vinyl or paraffin-coated paper is doubled by folding it back at its center a. The edge b of the folded back surface 11 is again folded back in the opposite direction for a short distance toward the original fold line a to form a tongue 12. The other surface, namely the lower surface of the sheet of material 10 may be provided with a suitable number of sectioning lines 14, a shown in FIG. 2, extending parallel to the wrapping direction.

Figure 2:
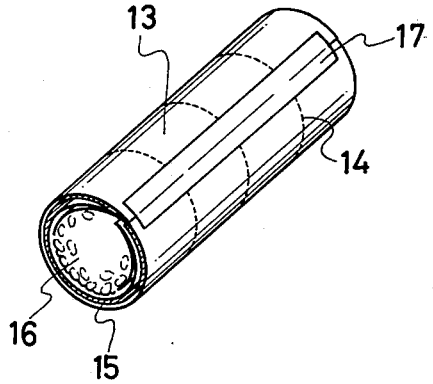
FIG. 2 is similar to FIG. 1 but shows a later stage of preparation in which the rice-ball is wrapped and packed with the laver retained in the interposed state.

In accordance with the present invention, a laver 15 is interposed between the folded-back surface 11 and the lower surface 13, and an elongated comestible, such as a rice-ball or bread and butter, 16 is placed on the single-layered portion c of the paper 10. The comestible, which will hereinafter be designated as a rice-ball, 16 is wrapped by the sheet 10 in one direction from its end d, whereby the rice-ball is wrapped and packaged with the laver 15 retained in the interposed state, as shown in FIG. 2. Pressure sensitive tape 17 is used to hold the edge a of the wound sheet 10 in place on the now-cylindrical package.

In this manner the laver 15 is packaged completely isolated from the rice-ball 16 by means of the moisture-proof paper 10. The laver therefore remains dry so that its original crisp taste can be enjoyed.

Figure 3:
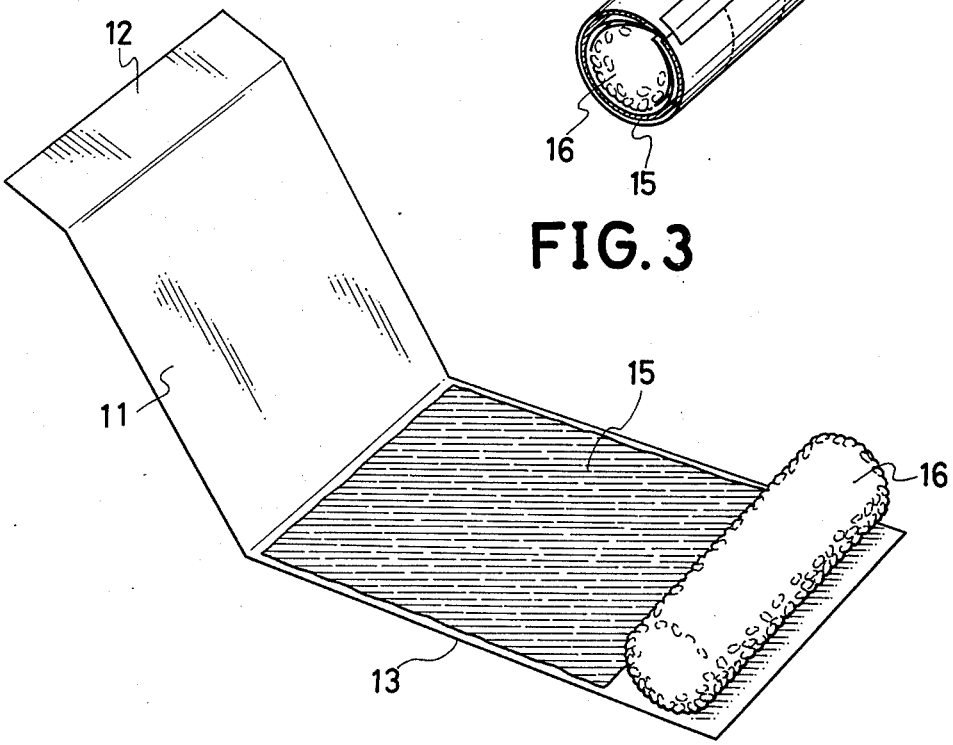
FIG. 3 shows the package of FIGS. 1 and 2 being spread out before the rice-ball is wrapped with the laver.

When the rice-ball is to be eaten, the tape 17 is stripped off and the wrapped package is unwrapped to the original state shown in FIG. 1, after which the sheet 10 is spread out by pulling on the tongue 12, as shown in FIG. 3. Next, the rice-ball 16 is rolled in one direction from the edge d along the lower surface 13 of paper 10 together with the laver 15, thereby wrapping; the laver around the rice-ball. Then, the paper 10 is removed to complete the formation of the laver-wrapped rice-ball. Thus, since the laver 15 and rice-ball 16 are not directly contacted by the hand of the person preparing the onigiri or sushi, a sanitary condition is maintained even if the laver-wrapped rice-ball is eaten during a picnic or the like. Wrapping and then eating one's own rice-ball also adds to the enjoyment.

In the case of a large laver-wrapped rice-ball, the rice-ball in the packaged condition may be cut along the parallel sectioning lines 14. Only the portions that have been so cut off are wrapped with the laver and then eaten as described above. This is convenient since the remaining portion can be left preserved in the packaged state.

Figure 4:
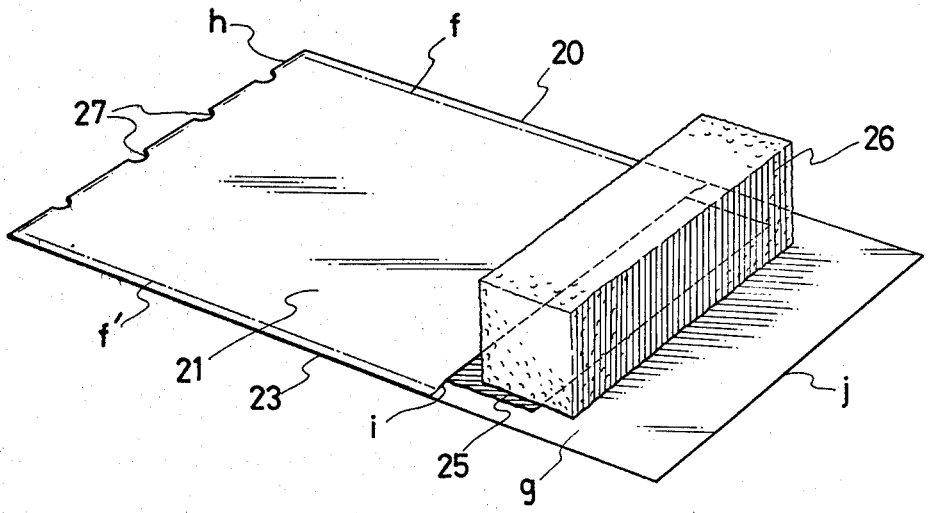
FIG. 4 is similar to FIG. 1 but shows another embodiment of the present invention.

FIG. 4 illustrates a second embodiment of the present invention. In this case the paper 20 is folded back leaving an extra portion g of a length greater than the width of the rice-ball 26. The borders f, f' on both sides of the folded-back portion and the corresponding borders of the lower surface 23 are sealed together by heat sealing to form a package 21. A suitable number of pinholes 27 are provided in the folded-back portion h at the bottom of the package.

In this embodiment, the laver 25 is inserted within the package 21, with the leading edge of the laver projecting slightly from the package opening i. A rice-ball or bread and butter is placed on the extra portion g of paper 20 so as to contact the projecting portion of the laver. The rice-ball is then wrapped in one direction from the edge j of paper 20 to form the package. Thus, in the case of the second embodiment, the laver is accommodated within the pckage to facilitate the moisture-proof effect. Moreover, the package has a favorable appearance and can be easily formed since air within the package can escape from the pinholes 27 in the bottom thereof when the package is wound. For eating, the package is unwrapped and restored to the state shown in FIG. 4. Then, if the rice-ball 26 is rotated without changing its position relative to the package 21, the leading edge of the laver 25 is engaged by the rice-ball, whereby the laver adheres to the outer periphery of the rice-ball and is automatically withdrawn from the package as the rice-ball is rotated. The rice-ball is therefore covered with the laver to complete the formation of the laver-wrapped rice-ball.

I claim:

1. A package for wrapping a moist comestible with a dry laver and substantially isolating the comestible from the laver comprising a long sheet of moisture-proof material folded at a central region thereof to form first and second juxtaposed portions, said first juxtaposed portion being below said second juxtaposed portion and longer than said second juxtaposed portion as measured from said central region toward the respective remote ends of said first and second portions to form an end region on said first portion, side edges of said first and second portions being sealed together to form, with said fold, a pocket substantially closed on three sides and open at a fourth side adjacent said remote ends; a dry laver within said pocket and extending from said open side to overlap at least part of said end region of said first portion extending beyond said remote end of said second portion; a transversely elongated moist comestible on said end region of said first portion, the extent of said end region of said first portion beyond said remote end of said second portion being substantially equal to the width of said comestible, the length of said comestible being substantially equal to the width of said sheet, said juxtaposed portions of said sheet with the portion of said laver therebetween being wrapped around said elongated comestible to substantially enclose said comestible with only the end portion of said laver extending from said pocket being in contact with said comestible.

2. The package according to claim 1 comprising a plurality of small holes in said central region of said sheet.

3. A package for wrapping a moist comestible with a dry laver and substantially isolating the comestible from the laver comprising a long sheet of moisture-proof material folded at a central region thereof to form first and second juxtaposed portions with said first juxtaposed portion being below said second juxtaposed portion, an end of said second juxtaposed portion remote from said central region being folded on itself by a length substantially shorter than the length of said second juxtaposed portion to form a tongue, said first juxtaposed portion adjacent a remote end thereof from said central region extending beyond said tongue to form an end region, an elongated, moist comestible elongated in a direction transverse to the length of said long sheet of moisture-proof paper disposed on said end region of said first juxtaposed portion and a dry laver disposed between said first and second juxtaposed portions having dimensions smaller than overlapping regions of said first and second juxtaposed portions, said elongated comestible being rolled within said end region of said first juxtaposed portion and the remainder of said first and second juxtaposed portions, and closure tape connecting the remote end of said first juxtaposed portion with said central region of said long sheet of moisture-proof material whereby, the package can be unrolled to expose the comestible and said second juxtaposed portion can be unfolded from said first juxtaposed portion using said tongue to expose said laver and said end region of said first juxtaposed portion can be used to aid in rolling said comestible with said laver.

* * * * *